US005367759A

United States Patent [19]

Loew et al.

[11] Patent Number: 5,367,759

[45] Date of Patent: Nov. 29, 1994

[54] METHOD OF ASSEMBLING A TUBULAR PROBE

[75] Inventors: Kathryn D. Loew, Bensonville; Anthony M. Oliver, Northlake, both of Ill.

[73] Assignee: Eaton Corporation, Cleveland, Ohio

[21] Appl. No.: 136,639

[22] Filed: Oct. 13, 1993

[51] Int. Cl.[5] ..... B21D 39/00

[52] U.S. Cl. ..... 29/512; 29/523; 29/243.517; 285/222

[58] Field of Search ..... 29/512, 523, 524.1, 29/844, 243.517, 890.038, 890.04, 890.044; 285/162, 205, 222

[56] References Cited

U.S. PATENT DOCUMENTS

| | | | |
|---|---|---|---|
| 866,644 | 9/1907 | Green | 29/523 |
| 1,220,438 | 3/1917 | McKenna | 285/222 |
| 1,656,856 | 1/1928 | Gagnon | 29/523 |
| 1,914,650 | 6/1933 | Reutter | 29/523 |
| 2,507,812 | 5/1950 | Phipps | 29/512 |
| 3,140,540 | 7/1964 | Greenman | 29/523 |
| 3,766,631 | 10/1973 | Scheitlin et al. | 29/523 |
| 4,130,932 | 12/1978 | Epmeier | 29/243.517 |
| 5,092,634 | 3/1992 | Miller | 285/222 |

*Primary Examiner*—Mark Rosenbaum
*Assistant Examiner*—David P. Bryant
*Attorney, Agent, or Firm*—Roger A. Johnston

[57] ABSTRACT

A method of upsetting and flaring a thin-walled metal tubular probe with one closed end onto a non-metallic plate in a single tooling set-up. The closed end of the tubing probe is inserted in a hole in the plate and a mandrel inserted in the open end of the tube and spring biased to register against the interior of the closed end of the tube which has an anvil washer received thereover which supports the tube wall. A pilot tool is registered against the closed end of the tube; and, an annular tool is received over the mandrel and registers against the open end of the tube. With the annular tool supporting axially the open end of the tube, the pilot tool is moved against the closed end of the tube and bulges a portion of the tube in a recess provided in the plate or in the anvil washer against one side of the plate. The annular tool is then moved axially to flare the open end of the tube against the opposite side of the plate.

3 Claims, 2 Drawing Sheets

METHOD OF ASSEMBLING A TUBULAR PROBE

BACKGROUND OF THE INVENTION

The present invention relates to the manufacture of tubular probe assemblies where it is desired to attach a thin walled metal tube having one exposed end thereof closed and the tube attached to a housing structure with one end open interiorly of the housing for insertion of desired electrical sensing articles into the tube. Tubular assemblies of this type are useful as sensing probes, and particularly, probes of the type employed for sensing temperature. The metal tube provides rapid heat conduction from the article or medium to be sensed; and, it is often desirable to mount the tubular probe to a non-metallic structure for housing associated electrical circuitry and connectors. Sensing probes of this type are often employed for sensing temperature where it is desired to provide a thermocouple in the closed end of the tube with the electrical leads of the thermocouple extending outwardly of the open end of the tube to the interior of the non-metallic housing structure upon which the tube is attached or carried.

Heretofore, various techniques of attaching the thin-walled tubular metal probe to a non-metallic housing have included such expedients as potting with epoxy resin and forming a non-circular shape to the open end portion of the tube and clamping the non-circular portion with appropriate correspondingly shaped surfaces formed in the housing structure. Both of these techniques have proven to be unwieldy and costly for probes utilized in high volume mass produced applications such as, for example, temperature sensing probes utilized in automotive air conditioning systems. Thus, it has long been desired to provide a way or means of attaching a metal tube having one end closed to a non-metallic housing structure in a low-cost and convenient manner conducive to high volume manufacturing of the tubular assembly.

SUMMARY OF THE INVENTION

The present invention provides a single station tooling arrangement for attaching a relatively thin-walled metal tube having one end closed to a non-metallic housing structure such as a plastic plate. The closed end of the tube is inserted through an aperture formed in the plate and an annular anvil washer is received over the closed end of the tube protruding through the plate on the exterior side thereof. A pilot tool is received in the anvil washer and registered against the closed end of the tube; and, a spring is employed for biasing the anvil against the exterior side of the plate. A mandrel is inserted into the open end of the tube from the interior side of the plate or housing and an annular collar tool received over the mandrel with one axial end registered against the open end of the tube. The mandrel is biased by a spring having one end registered against the end of the mandrel and the other end registered against the annular tool. A cover tool or shell is received over the annular tool and has an internal spring biasing the annular tool against the open end of the tube. The tool shell is rigidly supported and the pilot tool moved axially against the closed end of the tube with the mandrel biased thereagainst interiorly of the tube. The anvil supports the tube wall which is permitted to bulge in a recess provided in the plate as the pilot tool forces the closed end of the tube toward the plate. The bulge in the tube and the closed end of the tube are supported by the pilot tool on the exterior side of the plate while the cover tool is moved toward the plate from the interior side thereof against the open end of the tube. The movement of the cover tool causes the annular tool to flare the open end of the tube outwardly over the interior side of the plate, thus securing the tube to the plate with the plate between the flare and the bulge. The tooling is then removed axially from the interior side and exterior side of the plate, leaving the probe securely attached thereto with the closed end extending exteriorly thereof.

DETAILED DESCRIPTION

Figure 1:
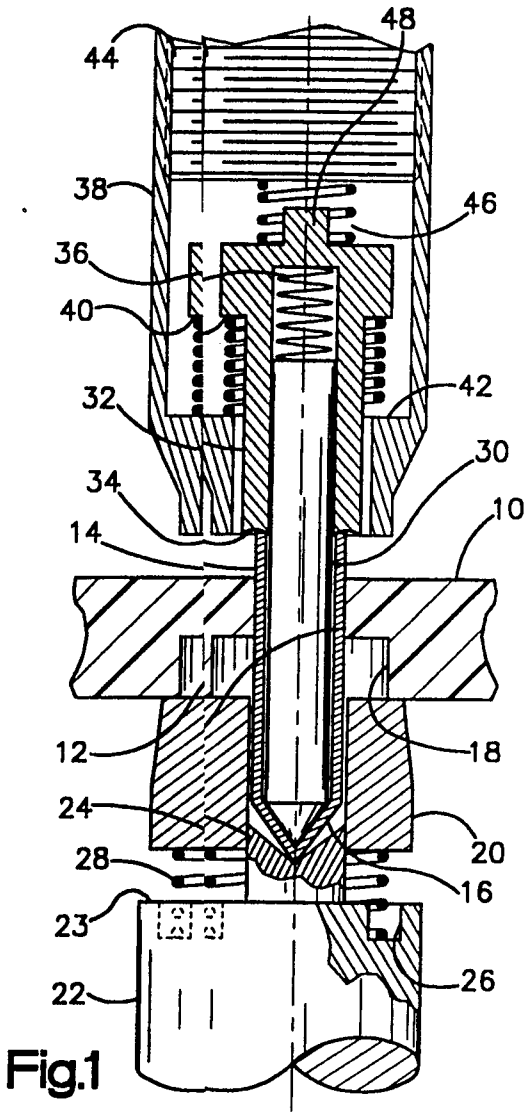
FIG. 1 is a cross-section of the tube inserted through a non-metallic plate, with the tooling initially assembled thereon.
Figure 2:
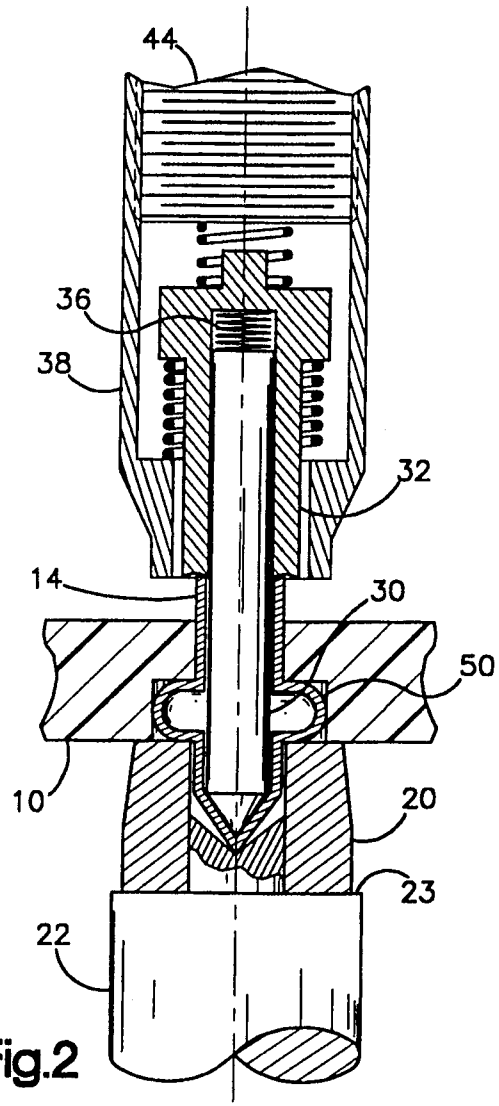
FIG. 2 is a view similar to FIG. 1, showing the closed end of the tubing moved upwardly and the tubing bulged on one side of the plate.
Figure 3:
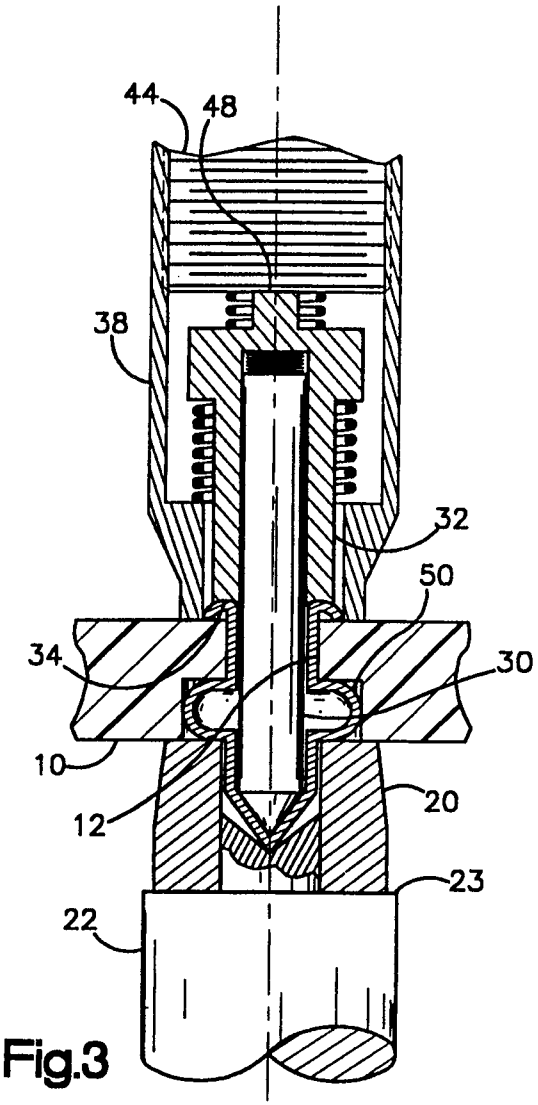
FIG. 3 is a view similar to FIG. 1, showing the tubing flared at its open end after bulging of the tube; and, FIG. 4 is a view similar to FIG. 3, showing an alternate arrangement for practicing the method of the invention.

Referring to FIGS. 1, 2, and 3, the non-metallic housing or plate is indicated at 10, and has an aperture 12 formed therein, with the relatively thin-walled metal tube 14 received therein with the closed end 16 of the tube extending downwardly in the drawings or outwardly from the exterior side of the plate 10. The aperture 12 closely interfits the outer periphery of the tube 14, which in the presently preferred practice of the invention has a circular configuration in transverse section.

An enlarged diameter recess 18 is provided in the aperture 12 on the exterior side thereof or underside of the plate with respect to FIGS. 1, 2, and 3. An annular supporting tool comprising an anvil washer 20 is received over the exteriorly-extending closed end of tube 16; and, the inner periphery of the anvil washer 20 is sized to provide support for the outer periphery of the portion of the tube extending within the anvil. A supporting tool 22 is provided with a reduced diameter pilot portion 24, which is received in the center space of the anvil washer 20. Pilot 24 has a concave surface formed in the upper end thereof which is registered against the closed end 16 of the tube 14. An annular recess 26 is formed in the tool 22, and has registered therein the lower end of a coil spring 28, which has its upper end biasing the anvil washer 20 into contact with the exterior surface or lower surface of the plate 10.

A mandrel is inserted into the tube from the upper or open end thereof; and, the lower end of the mandrel is configured to register against the interior of the closed end 16 of the tube 14. The mandrel extends upwardly beyond the end of the tube 14 and has received thereover an annular tool member 32 which has a concave annular recess 34 formed in the lower end thereof which registers against the open upper end of tube 14. The annular tool 32 has the upper end thereof closed with a spring 36 received therein with the upper end of the spring registered against the closed end of tool 32 and the lower end of spring 36 registered against the upper end of the mandrel 30 biasing the mandrel downwardly against the inner surface of the closed end 16 of the tube 14. In the initially assembled condition shown in FIG. 1, the upper end of the tube extends above the upper or interior surface of panel 10 by a predetermined amount to facilitate subsequent forming operations. An outer shell or cover tool 38 is received annularly over the tool 32 and has a spring provided interiorly thereof with the upper end registered against shoulder 40 on the tool 32, and with the lower end of the spring registered against a shoulder 42 provided in tool 38. A plug 44 is threadedly received in the upper end of the tool 38; and, a spring 46 is provided between the plug 44 and the upper end surface of tool 32. The spring 46 biases the plug and cover tool upwardly from the upper surface of the tool 32. A registry or stop 48 is provided on the upper surface of tool 32; and, stop 48 extends within the spring 46 to serve as a limit stop for compression of the spring 46.

Referring to FIG. 2, the tool 38 is restrained by any suitable expedient, for example, one jaw of an arbor press (not shown), and the tool 22 is forced upwardly by any suitable source of movement such as, for example, the opposite jaw of a press (not shown) to register against the lower surface of anvil 20 as shown in FIG. 2. The upward movement of tool 22 causes the pilot 24 to move the end of the tube 16 and mandrel 30 upwardly, compressing spring 36 and causing a portion of the tube 14 within the enlarged diameter 18 to form an annular convolution or bulged portion denoted by reference numeral 50 in FIG. 2. The tool 22 is moved upwardly until the shoulder 23 thereon is registered against the lower transverse surface of anvil 20, compressing spring 28 into the annular groove 26.

Referring to FIG. 3, with tool 22 registered against anvil 20, the outer cover or tool 28 is forced downwardly until the undersurface of plug 44 registers against the pilot 48, moving annular tool member 32 downwardly, causing the annular concave surface 34 to flare outwardly the upper end of tube 14 onto the upper surface of plate 10. Thus, the tube 14 is securely retained in the aperture 12 formed in plate 10; and, plate 10 is clamped axially between the flared end of the tube and the bulged portion 50. The tooling and mandrel may then be removed to provide an assembly of the tube 14 and plate 10.

Figure 4:
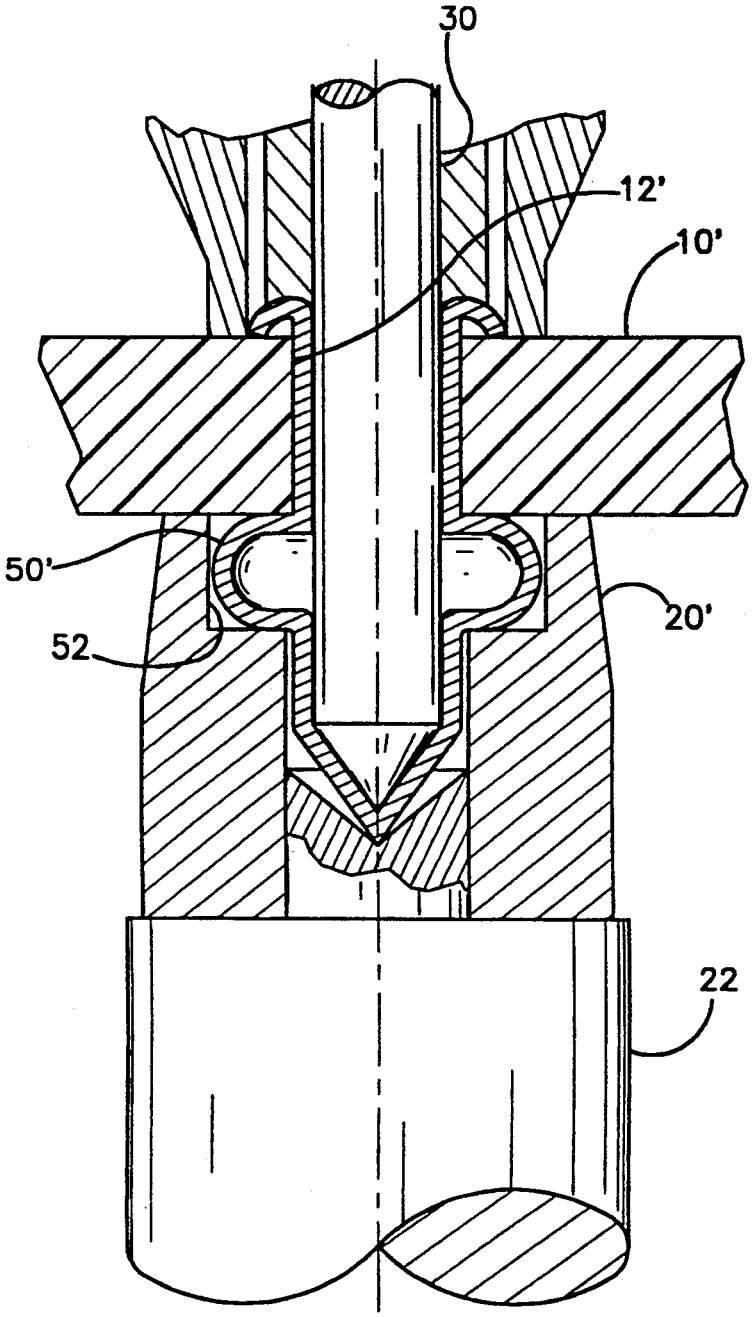

Referring to FIG. 4, another arrangement or technique of the invention is illustrated wherein a non-metallic plate 10' has an anvil 22' registered against the undersurface thereof, with an enlarged diameter 52 provided in the upper surface of the anvil 22' surrounding tube bulge 50'. The embodiment of FIG. 4 thus provides for the formation of the bulge within a recess 52 formed in the anvil, and eliminates the need for providing an enlarged diameter recess in the plate 10'.

The present invention thus provides a convenient single-station operation for assembling a thin-walled metal tube onto a non-metallic plate, forming a probe assembly by bulging the portion of the tubing adjacent the closed end against one side of the plate and flaring the open end of the tube onto the opposite side of the plate for clamping the plate between the bulge and flared portions of the tube. The tube is supported internally by a mandrel and the closed end is supported by an annular tool received over the mandrel. The closed end of the tube is supported by an annular anvil and a tool registered against the closed end of the tube moves the tube axially while supported by the mandrel to form the bulged portion. The annular tool registered against the open end of the tube is then moved toward the plate to flare the open end of the tube onto the plate.

Although the present invention has hereinabove been described with respect to the illustrated embodiments, it will be understood that the invention is capable of modification and variation, and is limited only the following claims.

We claim:

1. A method of attaching a relatively thin walled metal tube having an open end and a closed end to a non-metallic plate comprising:

(a) forming an aperture in the plate with a diameter slightly larger than the diameter of the tube with an enlarged diameter on one side of said plate and inserting the closed end of the tube such that it protrudes through the enlarged diameter;

(b) surrounding the protruding end of the tube with an annular spacer having a hole therein with a diameter slightly larger than the diameter of said tube;

(c) resiliently supporting the open end of the tube against axial movement on the side of the plate opposite the protruding closed tube end and inserting a mandrel in said tube and biasing the mandrel against the closed tube end;

(d) externally contacting the protruding closed end of the tube with a tool and driving the tool toward said plate to force the tube and said mandrel axially within said spacer and cause the tube to locally bulge in the enlarged diameter; and, (e) axially supporting the bulge in the tube with said spacer and the closed end of the tube with said tool and axially contacting the open end of said tube opposite said closed end with another tool and driving said another tool toward said plate to flare said open end against the plate.

2. A method of attaching a relatively thin walled metal tube having one end closed and the other end open to a non-metallic plate comprising:

(a) forming an aperture through the plate and sizing the aperture to closely fit the tube;

(b) inserting the closed end of the tube in the aperture from one side of the plate and extending the closed end beyond the opposite side of the plate;

(c) contacting and axially supporting the closed end of the tube with a pilot tool;

(d) inserting a mandrel in the open end of the tube and resiliently biasing an end of the mandrel axially against the closed end of the tube;

(e) disposing another tool annularly about the mandrel and axially biasing said another tool against the open end of the tube;

(f) axially resiliently supporting said another tool and said mandrel and annularly supporting the portion of the tube extending beyond the opposite side of the plate;

(g) moving said pilot tool toward said plate and causing the tube to bulge annularly against said opposite side of the plate; and, (h) axially supporting said bulge and said pilot tool and moving said another tool axially toward said plate and flaring the open end of the tube against said one side of the plate, thereby securing the tube in said aperture between said bulge and flare; and, removing said tools and mandrel.

3. A method of assembling a relatively thin walled metal tube having an open end and a closed end to a non-metallic plate comprising:

(a) forming an aperture in the plate and inserting the closed end of the tube therethrough;

(b) positioning and axially supporting with an annular tool the open end of the tube relative to the plate;

(c) inserting a mandrel in the tube and supporting the closed end of the tube therewith;

(d) surrounding and registering another tool against the closed end of the tube;

(e) moving said another tool toward the plate and bulging a portion of said tube annularly against one side of the plate;

(f) moving said annular tool toward the opposite side of the plate and flaring the end of the tube outwardly against the plate, thereby clamping said plate between the flared and bulged portion of the tube; and, (g) removing said tools and mandrel.

* * * * *